US005152122A

United States Patent [19]

DeBarber et al.

[11] Patent Number: 5,152,122

[45] Date of Patent: Oct. 6, 1992

[54] METHOD FOR ADJUSTING AN INSERTING MACHINE

[75] Inventors: Christopher DeBarber, Woodbury; Carlos L. DeFigueridо, Danbury, both of Conn.

[73] Assignee: Pitney Bowes Inc., Stamford, Conn.

[21] Appl. No.: 785,113

[22] Filed: Oct. 30, 1991

[51] Int. Cl.[5] ..... B65B 59/00

[52] U.S. Cl. ..... 53/460; 53/201; 53/284.3; 33/476; 493/478

[58] Field of Search ..... 53/460, 569, 284.3, 53/201; 493/476, 475, 478, 479; 33/476, 522, 494, 616, 679.1, 566, 1 G

[56] References Cited

U.S. PATENT DOCUMENTS

Re. 13,273 7/1911 Staude ..... 493/478
3,319,395 5/1967 Lundquist et al. ..... 53/284.3
4,548,400 10/1985 Foster et al. ..... 493/479 X
5,067,305 11/1991 Baker et al. ..... 53/460 X

*Primary Examiner*—James F. Coan
*Attorney, Agent, or Firm*—Charles R. Malandra, Jr.; Melvin J. Scolnick

[57] ABSTRACT

A method of adjusting inserting apparatus capable of inserting a plurality of documents into envelopes of varying size. The method includes locating an envelope with an open flap on a template having a plurality of scales thereon for determining whether or not the inserting apparatus can accommodate the size of the envelope placed on the template and for adjusting a plurality of adjustable mechanical elements of the inserting apparatus in order to process the envelope placed on the template, and adjusting the mechanical elements in accordance with the readings on the scales.

8 Claims, 3 Drawing Sheets

METHOD FOR ADJUSTING AN INSERTING MACHINE

BACKGROUND OF THE INVENTION

The instant invention relates to apparatus for inserting documents into envelopes, and more particularly to a method for adjusting the inserting apparatus to accommodate the particular size envelope being used.

Inserting machines are well known as apparatus for collecting a plurality of documents from feeders located upstream and inserting them into envelopes. Typically, the envelope must then be turned, usually 90 degrees, in order to facilitate sealing of the envelope and a subsequent application of postage indicia. The conventional inserting machines, envelope turners and envelope sealers all contain adjustments which must be set in accordance with the size of the envelope being processed, since each of these machines is capable of handling a range of different size envelopes.

Typically, the inserting machine includes claws for opening the throat of the envelope which need to be set prior to running the inserter. The inserter also includes a feeder having side guides which require adjustment dependent on the size of the envelope, and a queing station where the documents are stopped and registered prior to insertion into the envelope, which requires an adjustment dependent on the envelope size. The turning device includes registration stops for stopping the envelope prior to turning which need adjustment dependent on envelope size, and the envelope sealer includes a guide which also needs an adjustment dependent on envelope size.

It is known to employ various types of gages in connection with setting up an inserting apparatus to run, such as those disclosed in U.S. Pat. Nos. 4,418,515 and 4,548,400, assigned to the assignee of the instant application. However, all of the prior art gages require that the envelope be maneuvered several times in order to execute the appropriate adjustments. The instant invention overcomes this prior art problem by providing a method of adjusting inserting apparatus using a template which requires that the envelope simply be placed once on the template which, by means of various scales, indicates all of the necessary adjustments for the inserting apparatus.

SUMMARY OF THE INVENTION

The instant invention provides a method of adjusting an inserting apparatus capable of inserting a plurality of documents into envelopes of varying size. The method includes locating an envelope with an open flap on a template having a plurality of scales thereon for determining whether or not the inserting apparatus can accommodate the size of the envelope placed on the template and for adjusting a plurality of adjustable mechanical elements of the inserting apparatus in order to process the envelope placed on the template, and adjusting the mechanical elements in accordance with the readings on the scales.

DETAILED DESCRIPTION OF THE PREFERRED EMBODIMENT

Figure 2:
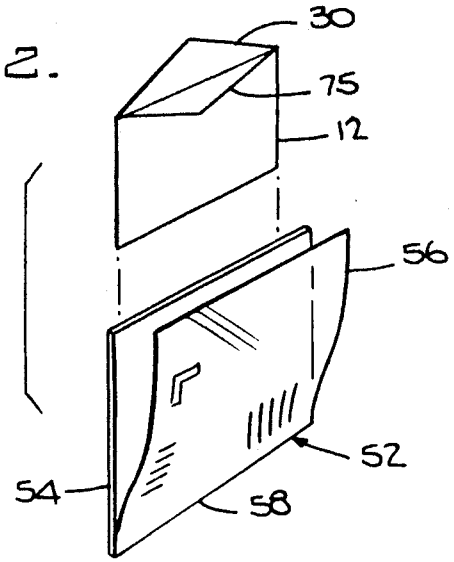
FIG. 2 is a perspective view of an envelope and the template seen in FIG. 1 prior to the envelope being inserted into the template.
Figure 3:
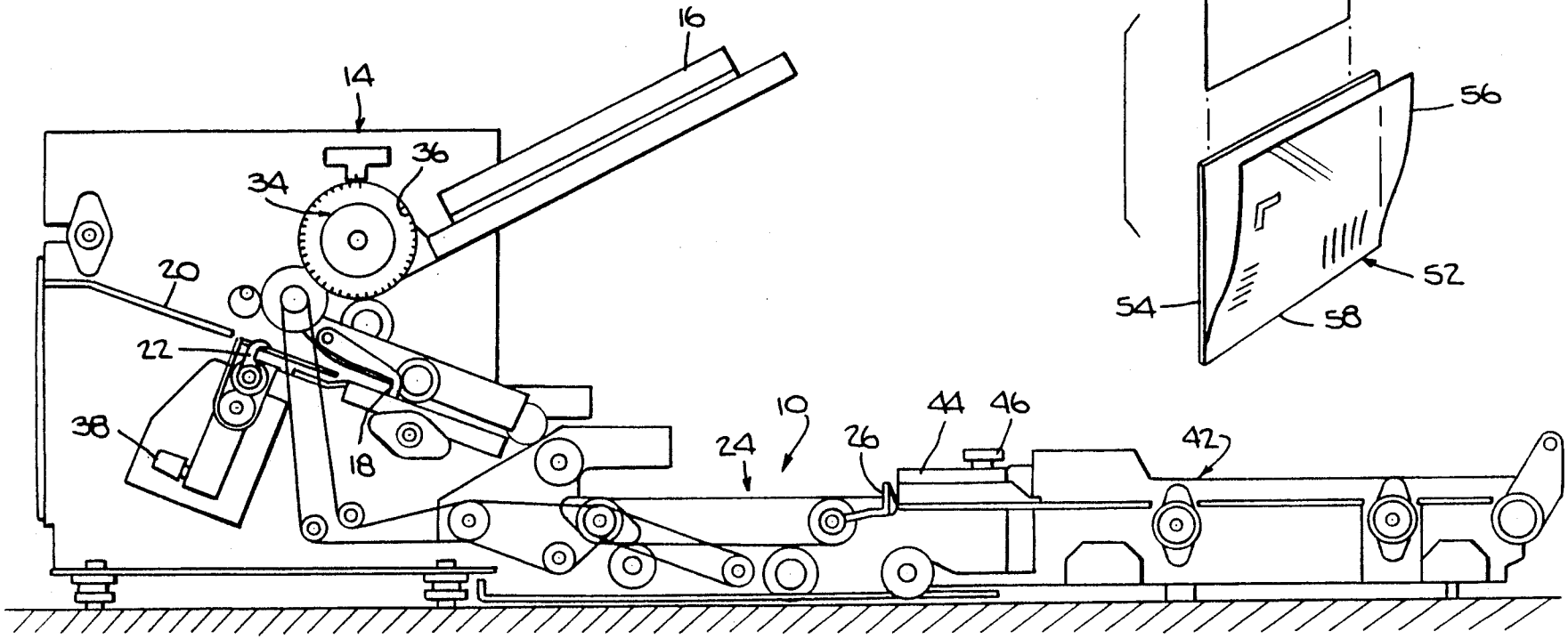
FIG. 3 is a side, elevational view of an inserting apparatus used in the instant invention.
Figure 4:
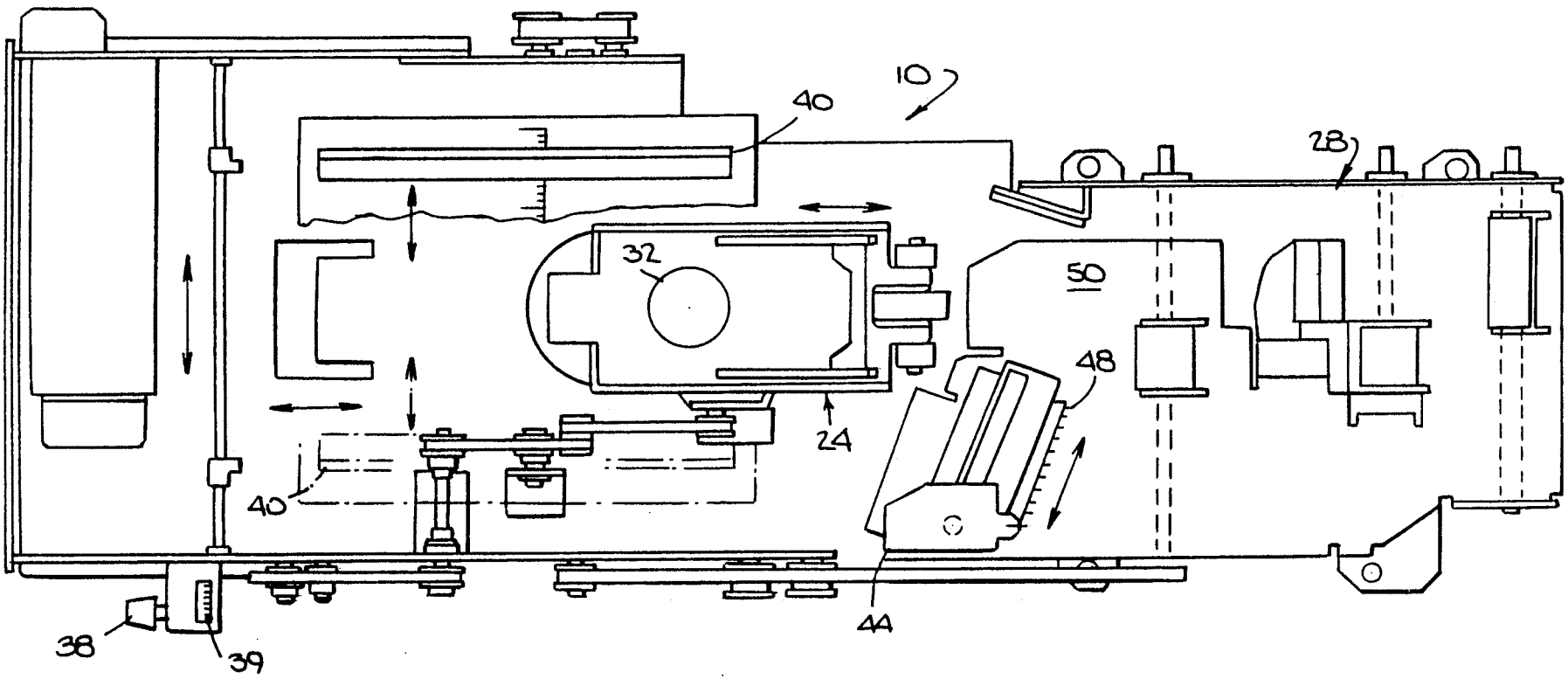
FIG. 4 is a top, plan view of the inserting apparatus seen in FIG. 3.

In describing the preferred embodiment of the instant invention, reference is made to the drawings, wherein there is seen in FIGS. 3 and 4 inserting apparatus generally designated 10 for inserting documents (not shown) into an envelope 12 (see FIG. 2). The inserting apparatus 10 includes an envelope inserting machine 14 having a hopper 16 for storing a supply of envelopes 12 which are fed to a queue station stop 18. Documents are fed from document feeders (not shown) located upstream of the inserting machine 14 along a feed deck 20 toward the stopped envelope 12. When the envelope 12 is stopped by the queue station stop 18, a pair of envelope throat opening claws 22 separate the front and back panels of the envelope 12 so that the documents can be inserted into the envelope 12.

After the envelope 12 is stuffed with documents, it is fed toward an envelope turning machine 24 (see FIG. 4) where a pair of registration stops 26 are raised in order to stop and align the envelope 12 prior to a 90 degree (or 180 degree if required) turn. After the envelope 12 has been turned, it is further fed to a sealing machine 28 which wets the glue flap 30 and then secures the glue flap 30 to the back panel of the envelope 12 in conventional manner.

The queue station stop 18 is adjustable and can be moved closer or further away from the claws 22 in order to accommodate envelopes of various height. Similarly, the turner stops 26 are adjustable and can be moved closer or further away from a turning device 32 (see FIG. 4) which includes mating parts for gripping and turning the envelope 12. The adjustment of the queue station stop 18 and the turner stop is effected by an adjustment knob 34 having a scale 36 to be discussed further hereinbelow. The queue station stop 18 and the turner stops 26 are moved simultaneously by the adjustment knob 34. It is also possible to pull the knob 34 out and effect only an adjustment of the queue station stop 18, which is a finer adjustment than that achieved by the knob 34 being in and adjusting the stop 18 and turner stops 26.

The movement of the claws 22 can be adjusted by means of a knob 38 depending on the width of the envelope 12 to move closer or further apart to one another. The envelope hopper 16 includes a pair of side guides 40 which can be adjusted to accommodate envelopes of various width. The guides 40 include a scale to facilitate adjustment thereto. Associated with the knob 38 is a scale 39 (see FIG. 4) to be discussed in detail hereinbelow.

Downstream of the turning device 32 is the sealing unit 28 for sealing the flap 30 of the envelope 12 to the back panel of the envelope 12. A sealer guide 44 can be moved in the direction of the arrows seen in FIG. 4 in order to accommodate envelopes of varying heights. The sealer guide 44 includes a knob 46 which can be loosened in order to slide the guide 44 in the direction of the arrow seen in FIG. 4. A scale 48 is located on the deck 50 of the sealing unit 42.

Figure 1:
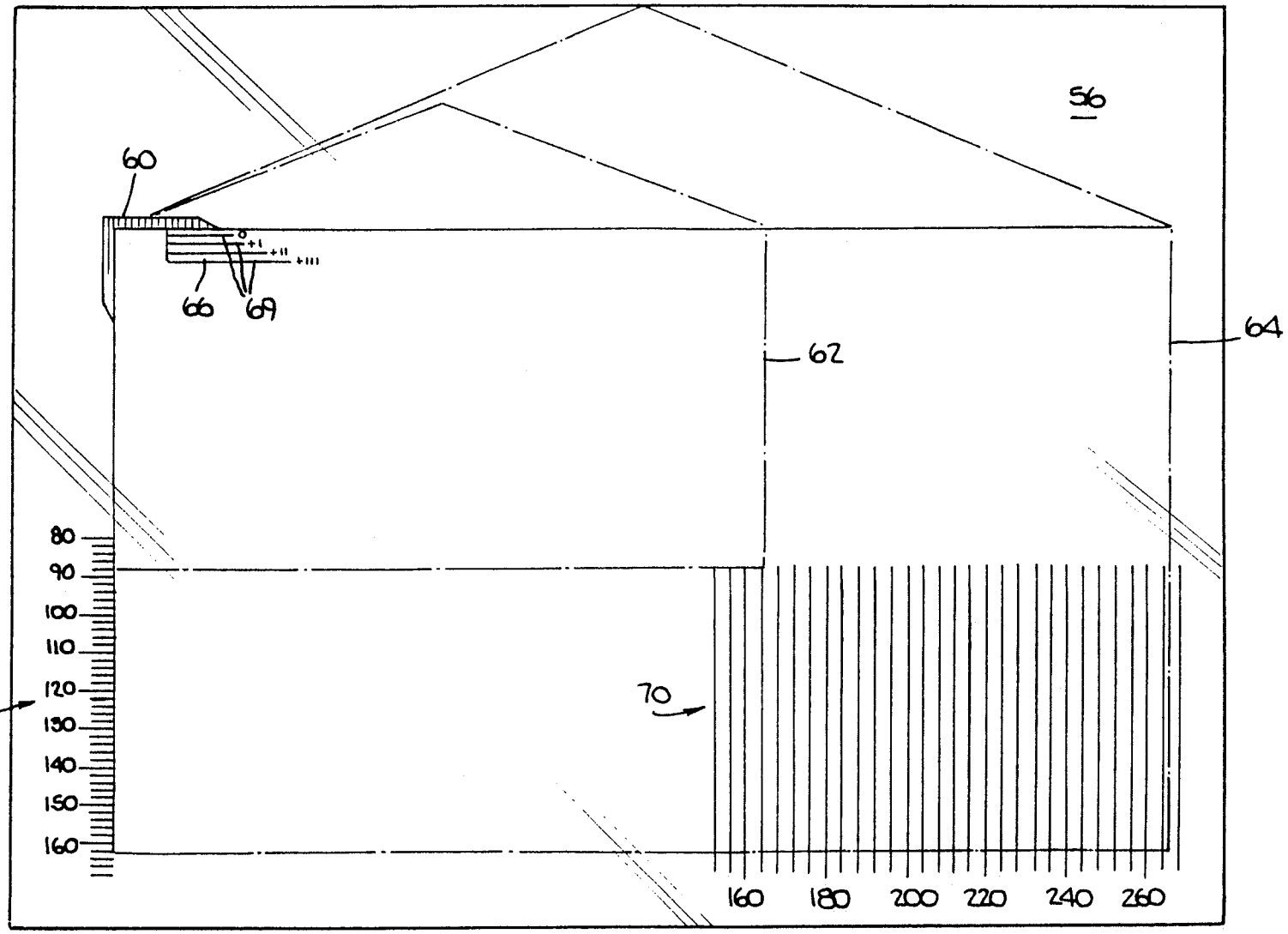
FIG. 1 is a top, plan view of a template used to set up inserting apparatus in accordance with the instant invention.

Referring now to FIG. 1, there is seen a template 52 consisting of a backing support 54 (see FIG. 2) and a transparent front sheet of plastic 56 which is secured to the backing support 54 along an edge 58. The transparent sheet 56 is marked with several guides and scales to be discussed hereinbelow. The sheet 56 includes an L-shaped locating guide 60 and an outline of a small envelope 62 and an outline of a large envelope 64, each outline having the envelope flap open. In the upper left corner of the sheet 56 adjacent the guide 60 is a scale 66 for fine adjustment of the queue station stop 18. The lower, left side of the sheet 56 includes a scale 68 relating to adjustment of the turner stops 26 and the sealer envelope guide 44. The lower, right corner of the sheet 56 includes a scale 70 for adjustment of the envelope hopper side guides 40 and the envelope throat opening claws 22.

The template 52 is used by an operator of the inserting apparatus 10 prior to the inserter 10 being run in order to assure that the apparatus 10 is properly adjusted to accommodate the particular size envelope 12 being run. To use the template 52, the operator places the envelope 12 being run between the backing support 54 and the front plastic sheet 56 of the template 52 with the envelope flap 30 open and the upper, left corner of the envelope 12 positioned immediately adjacent and inside the L-shaped guide 60.

The first check, once the envelope is inserted onto the template 52, is to determine that the envelope width, length and flap size fall between the smallest size possible which the inserter 10 can process as indicated by the envelope outline 62 and the largest size envelope which the inserter 10 can process a indicated by the large envelope outline 64. If the envelope 12 does not fit between the two outlines 62 and 64 it cannot be processed. This step eliminates the trial and error of running the inserter 10 to determine if the envelopes 12 are too large or too small.

Having determined that the inserter 10 can process the particular size envelope 12, the adjustments to the inserter 10 can be made. The lower left scale 68 matches the scale 36 on the adjustment knob 34 for the queue station stop 18 and the turner stops 26. The bottom of the envelope 12 will line up with a number on the scale 68 which determines the setting on the adjustment knob scale 36.

The lower right scale 70 matches a scale 39 associated with the knob 38 which adjusts the envelope throat opening claws 22 and the scale associated with the hopper side guides 40. The right side of the envelope 12 will line up with a number on the scale 70 which then determines the setting on the knob 38.

Finally, the queue station stop fine adjustment scale 66 includes a plurality of parallel lines 69 one of which will intercept the throat line 75 (see FIG. 2) of the envelope 12. The queue station stop 18 can be finely adjusted by the knob 34 being pulled out and rotated so that rotation of the knob 34 does not affect the turner stops 26. The lines 69 each include an indication of the amount of adjustment necessary for the knob 34 to finely adjust the queue station stop 18.

It should be understood by those skilled in the art that various modifications may be made in the present invention without departing from the spirit and scope thereof, as described in the specification and defined in the appended claims.

What is claimed is:

1. A method of adjusting inserting apparatus capable of inserting a plurality of documents into envelopes of varying size, comprising:

a. locating an envelope with an open flap at a locating guide on a template having a plurality of scales thereon for determining whether or not the inserting apparatus can accommodate the size of the envelope placed on the template and for adjusting a plurality of adjustable mechanical elements of the inserting apparatus in order to process the envelope placed on the template;

b. determining adjustment settings for said plurality of adjustable mechanical elements by reading each of said adjustment settings from said plurality of scales with the envelope kept at said locating guide on said template; and c. adjusting said mechanical elements in accordance with the adjustment settings read on said scales.

2. The method of claim 1, wherein the inserting apparatus includes an envelope inserting machine, an envelope turning device and an envelope sealing device.

3. The method of claim 2, wherein the inserting machine includes an adjustable queue station stop, a hopper for storing a supply of envelopes, and a pair of adjustable envelope throat opening claws, said hopper having a pair of adjustable side guides.

4. The method of claim 3 wherein said envelope turning device includes an adjustable registration stop.

5. The method of claim 4, wherein said envelope sealing device includes an adjustable guide.

6. The method of claim 5, wherein said template includes outlines of a maximum size and minimum size envelopes, a scale for fine adjustment of the queue station stop, a scale for adjustment of the registration stop and the sealing device guide, and a scale for adjusting the hopper side guides and the envelope throat opening claws.

7. A template device for determining adjustment settings for a plurality of adjustable mechanical elements relating to the processing of an envelope in an inserting apparatus comprising:

a backing support;

a transparent sheet secured along one edge to said backing support, said transparent sheet including a locating guide, and at least three scales relating to adjustment settings for a plurality of adjustable mechanical elements of the inserting apparatus wherein all of said adjustment settings for an envelope are determined when an envelope is registered at said locating guide between aid backing support and said transparent sheet.

8. The template device of claim 7, wherein said transparent sheet further includes outlines of maximum size and minimum size envelopes, a scale for fine adjustment of the queue station stop, a scale for adjustment of the registration stop and the sealing device guide, and a scale for adjusting the hopper side guides and the envelope throat opening claws.

* * * * *